US007745767B2

(12) United States Patent
Bredy

(10) Patent No.: US 7,745,767 B2
(45) Date of Patent: Jun. 29, 2010

(54) METHOD OF CONTROL OF AN AMMUNITION OR SUBMUNITION, ATTACK SYSTEM, AMMUNITION AND DESIGNATOR IMPLEMENTING SUCH A METHOD

(75) Inventor: Thierry J. M Bredy, Saint Doulchard (FR)

(73) Assignee: Nexter Munitions, Versailles (FR)

( * ) Notice: Subject to any disclaimer, the term of this patent is extended or adjusted under 35 U.S.C. 154(b) by 154 days.

(21) Appl. No.: 11/415,180

(22) Filed: May 2, 2006

(65) Prior Publication Data

US 2007/0028791 A1 Feb. 8, 2007

(30) Foreign Application Priority Data

May 2, 2005 (FR) ..... 05 04469

(51) Int. Cl.
*F41G 7/00* (2006.01)
*F42B 15/01* (2006.01)
*F42B 15/00* (2006.01)

(52) U.S. Cl. ..... 244/3.16; 244/3.1; 244/3.11; 244/3.15; 89/1.11

(58) Field of Classification Search ..... 244/3.1–3.3; 89/1.11; 342/61, 62, 175, 195; 102/382, 102/384, 473, 501
See application file for complete search history.

(56) References Cited

U.S. PATENT DOCUMENTS 3,001,186 A * 9/1961 Baltzer ..... 244/3.11
3,156,435 A * 11/1964 Norton et al. ..... 244/3.14
3,338,534 A * 8/1967 Girsberger ..... 244/3.14
3,363,858 A * 1/1968 Dobbins et al. ..... 244/3.14
3,478,212 A * 11/1969 Turck ..... 244/3.12
3,695,555 A * 10/1972 Chadwick ..... 244/3.14
3,698,811 A * 10/1972 Weil ..... 244/3.13
4,018,405 A * 4/1977 Baker ..... 244/3.14
4,100,545 A * 7/1978 Tabourier ..... 342/62
4,143,835 A * 3/1979 Jennings et al. ..... 244/3.11
4,231,533 A * 11/1980 Durig ..... 244/3.16
4,324,491 A * 4/1982 Hueber ..... 244/3.16
4,442,431 A * 4/1984 Bleakney ..... 342/62
4,558,836 A * 12/1985 Kriegesmann ..... 244/3.11
5,310,134 A * 5/1994 Hsu et al. ..... 244/3.12
5,601,024 A 2/1997 Sepp et al.

(Continued)

FOREIGN PATENT DOCUMENTS

FR 2 747 185 10/1997

(Continued)

*Primary Examiner*—Bernarr E Gregory
(74) *Attorney, Agent, or Firm*—Steptoe & Johnson LLP

(57) ABSTRACT

The object of the invention is a method of control of an ammunition or submunition, and in particular of the control of initiation of fire and/or of control of a trajectory correction and/or of a direction of fire, from a target detection. The method consists of the following steps: (1) a field zone (2) is sweeped from the ammunition (6) or submunition using a laser beam (10), (2) a potential target (1) located on the field is spotted using a passive surveillance means (4), and (3) when the means of passive surveillance (4) detects the laser beam (10) transmitted by the ammunition or submunition, the transmission of an order of confirmation is controlled and/or of at least one off-target data via the means of surveillance (4) and towards the ammunition or submunition.

28 Claims, 10 Drawing Sheets

U.S. PATENT DOCUMENTS 6,260,792 B1 * 7/2001 Zwirn et al. ..... 244/3.11
6,262,800 B1 * 7/2001 Minor ..... 244/3.16
6,357,694 B1 * 3/2002 Adda ..... 244/3.13
6,626,396 B2 * 9/2003 Secker ..... 244/3.16
6,650,277 B1 * 11/2003 Wilkinson ..... 342/62
6,762,710 B2 * 7/2004 Wilkinson ..... 342/62
6,842,138 B1 * 1/2005 Wilkinson ..... 342/62
2004/0113834 A1 6/2004 Wilkinson

FOREIGN PATENT DOCUMENTS

GB 2 063 430 A 6/1981

* cited by examiner

METHOD OF CONTROL OF AN AMMUNITION OR SUBMUNITION, ATTACK SYSTEM, AMMUNITION AND DESIGNATOR IMPLEMENTING SUCH A METHOD

CLAIM OF PRIORITY

This application claims priority under 35 USC 119 to French Patent Application No. 05.04469, filed on May 2, 2005, the entire contents of which is hereby incorporated by reference.

The technical scope of the invention is related to control methods of initiation of fire for an ammunition or submunition using target detection as well as that of attack systems implementing such method.

BACKGROUND OF THE INVENTION

Patent FR2747185 reports on an attack system implementing a submunition equipped with a detector and a ground-based target designator.

This submunition spots the ground along a spiral curve during its descent path. When the submunition detects a laser pulse transmitted by the designator, initiation of the warhead is automatically triggered.

This device indicates a major disadvantage in that the performance of the designator is limited to the implementation of an ammunition or submunition with negligible sweep speed of detection (in the range of 50 meters per second).

To make this type of designator compatible with higher performance ammunitions or submunitions, therefore with higher sweep speeds, the transmission frequency of the laser pulse as well as its power should be increased in such proportions that operational use would hardly be possible.

Moreover, the ground-based designator described in patent FR2747185 is an active designator. It can therefore be easily spotted by the designated target.

SUMMARY OF THE INVENTION

Thus, the aim of the invention is to suggest an ammunition control method from a remote designator, wherein the method can be implemented with an ammunition or submunition of high sweep speed (higher than a few km/s) to secure remote control that is reliable, discrete and consuming little energy.

The invention is in particular concerned with the fire initiation control of the warhead on-board the ammunition or submunition.

The invention is also related to a method that allows for improved firing accuracy of ammunitions or submunitions by enabling self-correction of their trajectory, or direction of fire, or time of fire using data about the target collected at the designator level and in a discrete manner.

The invention also describes an attack system implementing such a method as well as both essential components of this attack system: the ammunition (or submunition) and the designator.

Thus, the object of the invention is a method of control of an ammunition or submunition, and in particular of the control of initiation of fire and/or of control of a trajectory correction and/or of a direction of fire, from a target detection, wherein the method comprises the following steps:

- a field zone is sweeped from the ammunition or submunition using a laser beam,
- a potential target located on the field is spotted using a passive surveillance means,
- when the means of passive surveillance detects the laser beam transmitted by the ammunition or submunition, the transmission of an order of confirmation is controlled and/or of at least one off-target data via the means of surveillance and towards the ammunition or submunition.

According to a particular embodiment, firing of the ammunition or submunition will only be initiated if it receives an order of confirmation.

In the case of an ammunition or submunition with on-board target detection means, initiation of fire will only be carried out if the ammunition or submunition has received an order of confirmation and moreover if its means of target detection confirm that the target has characteristics corresponding with those of a potential target.

The order of confirmation and/or the off-target data will have the ability to be transmitted via radio relay channel.

According to a preferred embodiment, the order of confirmation and/or the off-target data will be optically transmitted in the form of at least one laser pulse sent by the means of surveillance at the target and received, after reflection on the target, using means of detection on-board the ammunition or submunition.

As the ammunition or submunition is equipped with means of correcting trajectory and/or of direction of fire and/or of correcting of the time of fire, at least one off-target data can be transmitted via the surveillance means which will be determined by the surveillance means via localization of the laser beam sent from the ammunition or submunition with respect to at least two detection zones defined by the surveillance means, the off-target data being then used by the ammunition or submunition to carry out at least one correction of trajectory and/or of direction of fire and/or of time of fire.

The object of the invention is also an attack system that implements on the one hand at least one target designator, located on the ground, or on a vehicle, or carried by an airborne, and on the other hand at least one ammunition or submunition launched over a field zone and equipped with a warhead as well as means to secure its firing. This attack system implements the method according to the invention and it is characterized in that an ammunition or submunition is equipped with a laser source to secure field sweeping, wherein the target designator is moreover a designator spotting with a passive surveillance means a ground-based potential target, with the means of passive surveillance securing the detection of the laser beam transmitted by the ammunition or submunition, and means of transmission are provided and coupled with the designator to secure the transmission of at least one order of confirmation and/or at least one off-target data when the designator has detected the beam transmitted by the ammunition or submunition.

Advantageously the designator can integrate an off-target meter to determine the position of the laser beam transmitted by the ammunition or submunition with respect to at least two detection zones, the means of transmission securing in this instance the delivery of at least one off-target data to the ammunition or submunition which they could use to correct their trajectory and/or direction of fire and/or time of fire.

The designator will have the ability to send its order of confirmation and/or the off-target data in the form of at least one laser pulse aimed at the target.

The ammunition or submunition will be able to integrate at least one laser technology-based detection means associating a transmitter and a receiver, and securing delivery at a potential target and with a given laser beam repetitive frequency.

Advantageously the means of detection can also secure reception of the order of confirmation and/or the off-target data in the form of at least one laser signal transmitted by the designator.

The designator will have the ability to be carried by an aircraft such as a drone. Alternatively, the designator will be able to be ground-based or carried by a vehicle or infantryman.

The submunition or submunitions will have the ability to be dispersed over a field zone by a carrier such as a drone or a cargo projectile.

The object of the invention is also an ammunition or submunition aimed at being launched above a field zone, and which is made of a warhead as well as means to secure firing of the warhead, ammunition or submunition that allows for the implementation of the method according to the invention. This ammunition or submunition is characterized in that it includes at least one laser source with a direction of detection close to the warhead direction of attack, and securing delivery of a laser beam at a potential target, with a given repetitive frequency, during the flight of the ammunition or submunition, wherein the latter also integrates means for receiving an order of confirmation for the initiation of fire and/or at least one off-target data, these means of reception being coupled with a computer that controls initiation of the warhead, with the order of confirmation being provided by a distinct designator of the ammunition or submunition and integrating means of passive surveillance.

The ammunition or submunition will be able to be equipped with means of correcting its trajectory and/or direction of fire and/or its time of fire, means that are actuated by the computer via at least one off-target data provided by the remote designator.

The ammunition or submunition will be able to have at least one target detection means of optical technology which will be able to form the means of reception of the order of confirmation and/or the off-target data.

The ammunition or submunition will be able to have at least one target detection means of laser technology associating one transmitter and one receiver, wherein this means secure delivery with a given laser beam frequency.

The means of target detection will be able to also secure reception of the order of confirmation and/or the off-target data in the form of at least one laser signal.

The means of target detection will be able to be linked with the computer which will also include an algorithm of reconnaissance of at least one characteristic from the target under search.

Advantageously the computer can be programmed in such a way as to operate the ammunition or submunition according to at least two different modes out of the following three modes:

- initiation of fire for the warhead after detection of a target with given characteristics,
- automatic initiation of fire after reception of an order of confirmation,
- initiation of fire if an order of confirmation is received and if the target also has given characteristics.

The object of the invention is finally a target designator aimed at spotting a target on a field zone, and implementing also the method according to the invention. This designator is characterized in that it spots the target using a passive optical surveillance means, securing the detection of a laser beam transmitted by an ammunition or submunition, with the designator integrating furthermore means of transmission to secure transmission of one order of confirmation and/or at least one off-target data when it has detected the beam transmitted from the ammunition or submunition.

The target designator will have the ability to integrate an off-target meter to determine the position of the laser beam transmitted by the ammunition or submunition with respect to at least two detection zones, the transmission means securing delivery to the ammunition or submunition of at least one off-target data that can be used by the ammunition or submunition to correct its trajectory and/or its direction of fire, and/or its time of fire.

The means of transmission will be able to be radio-based to secure transmission of the order of confirmation and/or of off-target data via radio.

Advantageously the means of transmission can be an optical transmitter means sending at least one laser pulse towards the ammunition or submunition via the designated target.

BRIEF DESCRIPTION OF DRAWINGS

The invention will become more apparent from reading the following description of the various embodiments, with reference to the appended drawings in which.

DETAILED DESCRIPTION OF DRAWINGS

Figure 1:
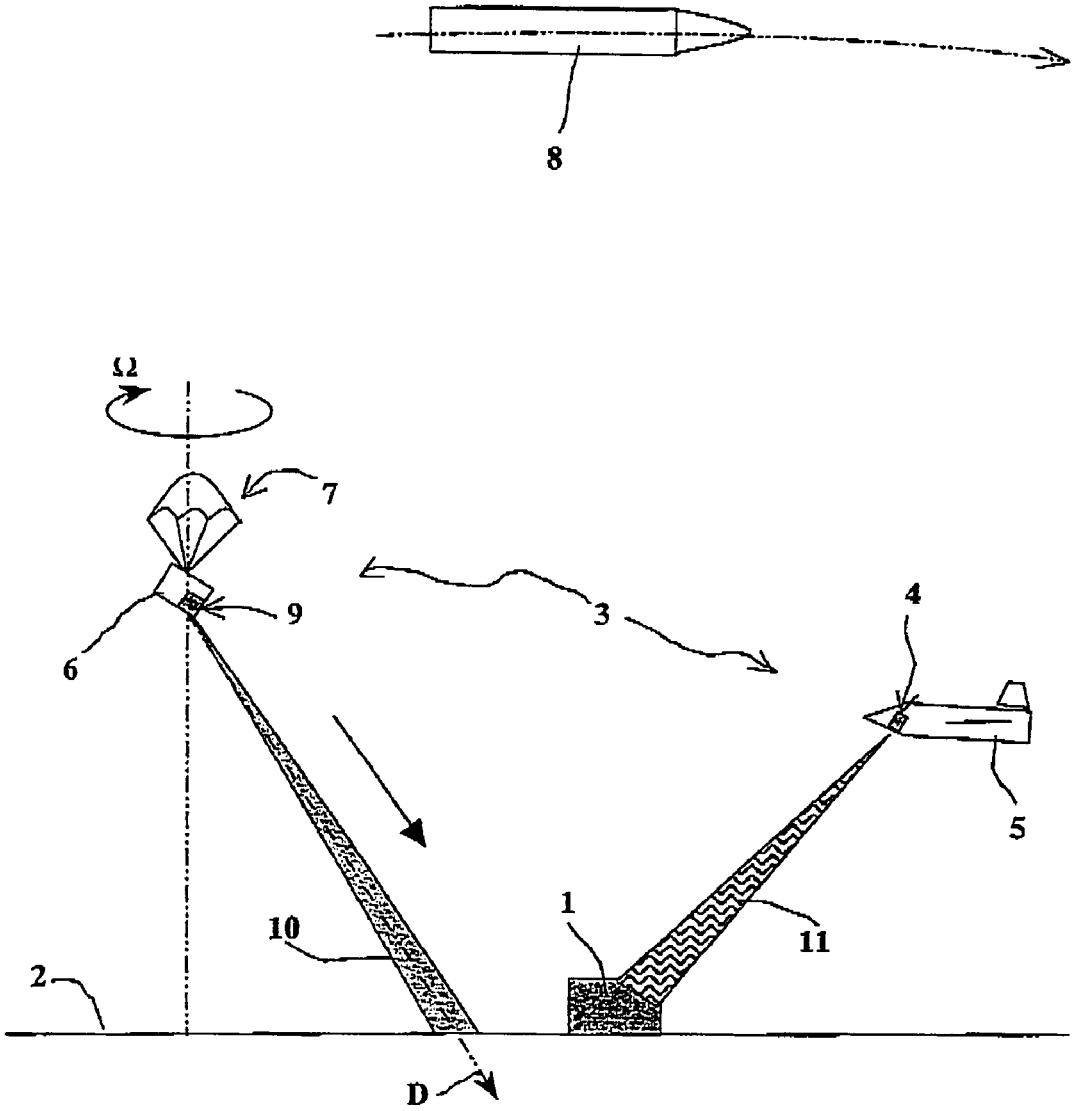
FIG. 1 is a schema of a mode of implementation for an attack system according to an embodiment of the invention.

FIG. 1 illustrates a target 1 located on operational field 2 and which must be destroyed using attack system 3 according to the invention. The target can be for example an armored vehicle or a command post.

This attack system consists of, on the one hand, a target designator 4 (or more generally a means of surveillance), which interacts here with an aerial system 5 (such as a drone), and on the other hand at least one ammunition or submunition 6 flying over the field zone and which consists of a warhead as well as means of securing its initiation. The submunition is stabilized here by using a means, such as a parachute 7 and it has been ejected above the field by a cargo projectile 8, for example an ammunition shell.

As cargo projectiles are well-known by someone skilled in the art, it is enough to refer for example to patent FR2741143 which describes such a dispersive cargo shell in antitank submunitions.

The warhead and its means of initiation are not illustrated in the figures. Such warheads are also well-known from someone skilled in the art and are not the object of the present invention. One can refer for example to patent FR2691797 which describes a priming device and to patents FR2793314 and FR2759158 which describe warheads of cargo projectile for dispersible submunitions.

The warhead has an attack direction D which is here significantly merged with a detection direction from an on-board means of detection 9 integrating a laser source.

The laser source secures delivery towards the ground 2 of a laser beam 10 with a given repetitive frequency of the order of a few kHz. The aperture of laser beam 10 is of the order of a few tenths of degrees, resulting in a laser spot of about 1 $m^2$ on the ground.

Moreover the target designator 4 includes a passive optical surveillance means, for example a matrix of detectors sensitive to the laser radiation transmitted by the detection device 9. This surveillance means is sensitive along the surveillance cone 11 which has an aperture of about 1°.

Figure 2:
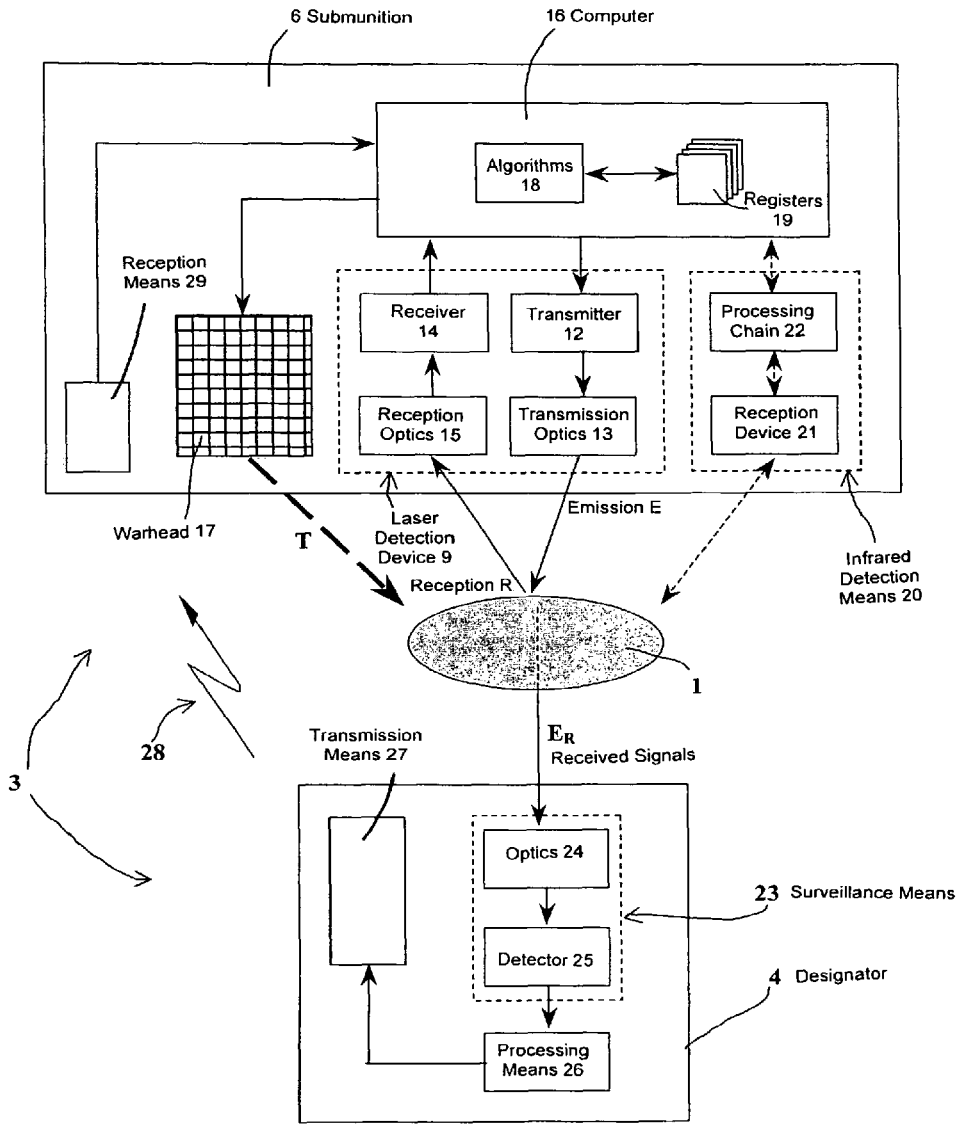
FIG. 2 is a schema illustrating the organization of an ammunition or submunition and of a designator according to a first embodiment of the invention, FIGS. 3*a*, 3*b*, 3*c* and 3*d* indicate four successive steps of operation for an attack system according to a mode of implementation from this first embodiment of the invention.

FIG. 2 gives a more detailed schema of the internal organization of submunition 6 and designator 4 according to a first embodiment of the invention.

Submunition 6 integrates in this instance a means of detection 9 which includes a laser transmitter 12 coupled with a transmission optics 13, and a receiver 14 coupled with a reception optics 15.

Transmitter 12 and receiver 14 are linked to a computer 16. The latter secures the initiation of signal transmission by transmitter 12 and secures the processing of signals received by receiver 14.

Computer 16 also allows for the control of initiation of fire of the warhead 17. It features algorithms 18 which secure in particular the comparison between the received signals and characteristics of potential targets stored in one or more memories or registers 19.

Such an architecture of means of detection 9 integrated in an ammunition or submunition is well-known from someone skilled in the art. Means of detection based on laser technology allow in particular for securing target ranging. Moreover the characteristics of signals reflected by a given target allow for recognition of a given target after processing (reconnaissance by pattern).

To improve target detection quality, the means of laser detection are mostly associated with means of detection that implement another technology, for example means of infrared optical detection or millemetric radar.

Another means of detection (for example infrared) have been worked out from rectangle 20 consisting of a reception device 21, such as a matrix of infrared radiation sensors, coupled with a signal processing chain 22. This detection means is also linked to computer 16.

In a usual way, computer 16 makes use of target data obtained from the means of laser detection 9 and infrared optics 20 in order to spot a target with thermal signature and a given profile, and afterwards initiate fire of the warhead 17 which is recommended to be a cargo projectile.

The attack system 3 according to the invention also includes a designator 4. The latter consists mainly of a passive optical surveillance means 23 that features an optics 24 and a detector 25 selected for its sensitivity to the wave length of the laser radiation E transmitted by transmitter 12.

The designator also includes means of processing 26 of received signals coupled with means of transmission 27. The implementation of the processing means is to recognize the signal provided by detector 25.

It will be possible to compare for example the frequency of received signals $E_R$ (signal E reflected on the target) with that of signals that should normally be transmitted by the ammunition or submunition. It will also be possible to integrate at the level of processing means 26 a decoding means which will allow for example reconnaissance of the signal transmitted by the ammunition or submunition (for example with the aim of avoiding deluding of the designator). The laser signal will thus be able to be coded.

When the means of surveillance 23 receive a laser beam transmitted from an ammunition or submunition and when the processing means 26 has checked that this received signal was compliant with what was expected, the processing means 26 controls transmission via the transmission means 27 of an order of confirmation 28.

The system 27 illustrated here in a schema is a radio transmission means. The ammunition or submunition integrates in this instance a means of reception 29 of this order of confirmation for initiation of fire (antennae and decoding circuit). The means of reception are coupled with a computer 16 which controls initiation of the warhead.

The operation of this embodiment will now be described by referring to FIGS. 3*a*, 3*b*, 3*c* and 3*d*.

Figure 3A:
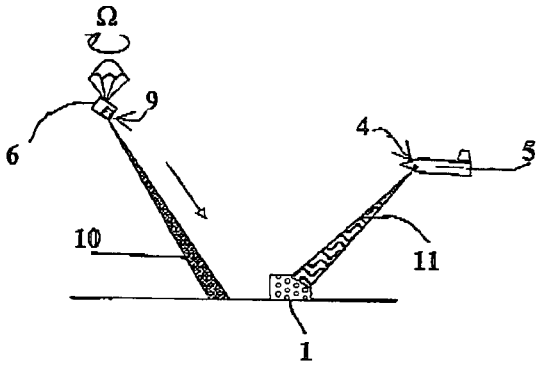
Figure 3B:
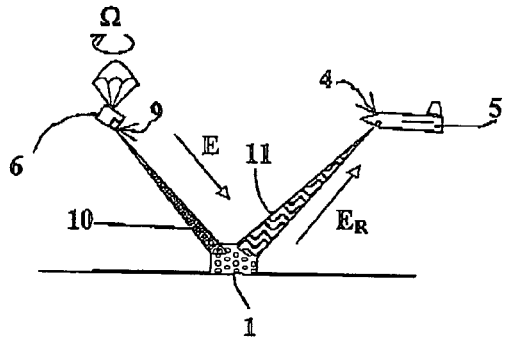

The first step is illustrated in FIG. 3*a*. The designator 4 carried by the drone 5 has its surveillance cone 11 aimed at a target 1.

As a result of the surveillance means of designator being passive, the target 1 cannot detect such a designation.

A non-represented vector (such as a cargo projectile or another drone) has dispersed above the field at least one submunition 6 spinning with rotational movement Ω. This submunition transmits towards the ground a laser beam 10 along a spiral path and securing a sweeping scan of the ground.

When the beam 10 meets the target 1 (FIG. 3*b*) part of the transmitted laser beam E is reflected (arrow $E_R$) and the laser radiation is then spotted by the surveillance means of designator 4.

Figure 3C:
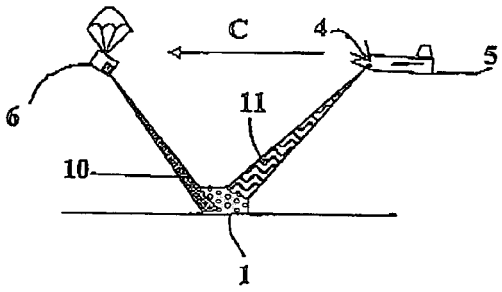

The designator recognizes the signal transmitted by a submunition 6 to which it is associated and it transmits then a signal of confirmation (arrow C) towards the submunition (FIG. 3*c*).

Figure 3D:
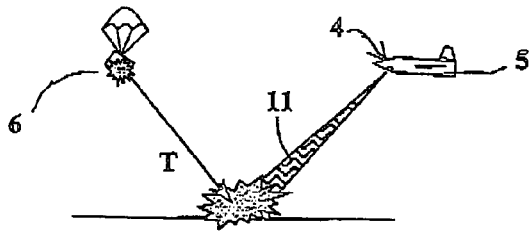

When the submunition receives the signal of confirmation, its computer 16 authorizes firing (T) of the warhead towards the target (FIG. 3*d*).

The repetitive frequency of the laser signal will be selected so that initiation can be triggered when the submunition is found pointed towards the target (direction of action D intercepting the target).

For a submunition spinning on itself with a rotational movement of an order of tenth of turns per second, it is enough to transmit a laser beam 10 with repetitive frequency of a few kHz which is easily feasible technically.

Thus, it is clear that thanks to the invention, it is possible to secure a designation operation with a fast rotating submunition, which is the case of dispersible antitank submunitions produced today.

It is obvious also that the invention allows for securing a discrete and reliable designation of a target.

It has been seen that with the method according to the invention, fire initiation of the submunition was carried out only if the submunition was receiving an order of confirmation.

Submunitions manufactured today operate autonomously. They sweep the field with their surveillance beams and only initiate fire if they see a target with given characteristics that are stored in memory (infrared signatures, radar, laser reflectivity, profiles, etc.).

The invention allows for improved operation of these submunitions. In fact they can be optionally operated either autonomously (conventional operation) or they can be operated only if a target with desired characteristics is also designated (confirmation mode) or yet they can be operated systematically on receiving an order of confirmation (semi-active mode without target reconnaissance).

With relatively simple means, three different operating modes can be obtained, two of which allow for selection of the targets to be processed. It is thus possible to limit the undesired effects and secure a more accurate hit on the battle field and in particular in urban areas.

It is also possible to control a target attack where the target signature would not have been sufficient to trigger initiation of the warhead. The operational capabilities of the attack system are thus also expanded.

Figure 4:
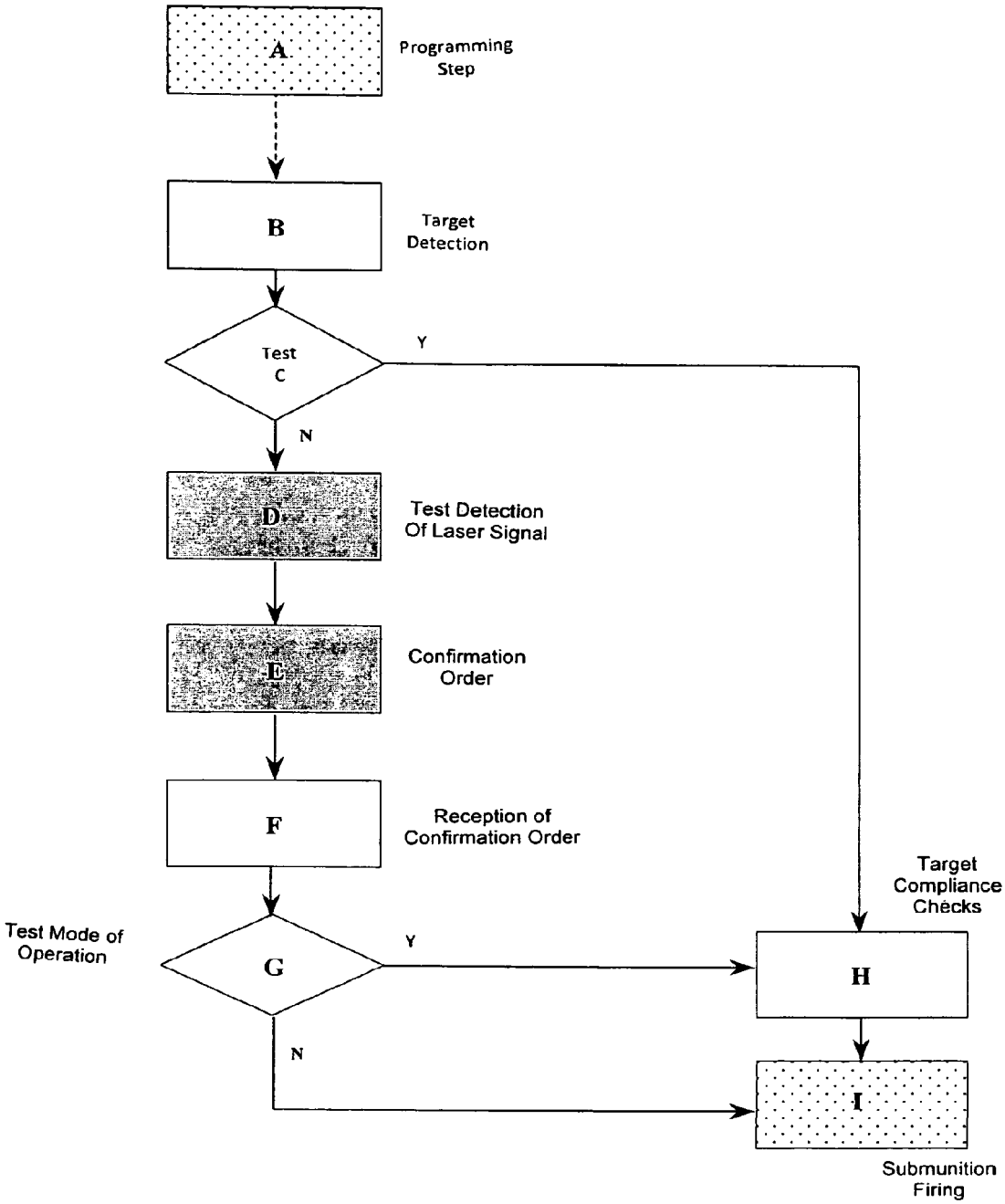
FIG. 4 is a logical diagram illustrating the different modes of operation for an attack system according to the invention.

The logical diagram in FIG. 4 thus schematically illustrates the different operating steps of the method according to the invention.

Block A corresponds to a programming step of the desired operating mode. This step can be carried out before fire or dispersion of the submunition. It corresponds to a selection of instructions at the level of algorithms from the computer 16 on-board the ammunition or submunition.

With the ammunition or submunition located above the field, step B corresponds to a target detection by the submunition, for example by means of laser detection.

Test C corresponds to a first verification of the type of programming carried out: autonomous operation or not.

If the submunition has been programmed to operate autonomously, the computer 16 secures (block H) the different tests of target reconnaissance before fire initiation (block I). This operation is that of dispersible antitank submunitions as known today.

If the mode selected is not the autonomous mode, the submunition waits for a signal of confirmation.

Block D corresponds to a step carried out at the level of the designator. The latter waits for detection of the laser signal transmitted by the submunition. When it is received, the designator transmits an order of confirmation (block E).

Block F corresponds to reception by the submunition of the order of confirmation transmitted from the designator.

Test G corresponds to another selection at the submunition level between two different modes of operation (simple target confirmation mode or not). This selection depends also on the programming provided before firing.

When the target confirmation mode has been selected, the submunition further checks the compliance of the designated target with the nominal expected characteristics (block H). And fire is only initiated if there is effectively a target reconnaissance. This mode is used to avoid multiple fire on a target already attacked or friendly fire.

If the mode of confirmation has not been selected (negative G test), this means that initiation of fire is wanted directly on the designation. Firing the submunition is then automatically initiated (step I). One can thus have a true semi-active operation, the submunition can therefore attack targets for which its means of detection are not designed. It is enough to simply secure their designation using passive designator 4.

FIGS. 5*a* to 5*d* show another mode of implementation for the invention using a ground-based designator 4.

The operation is similar to that described previously.

Figure 5A:
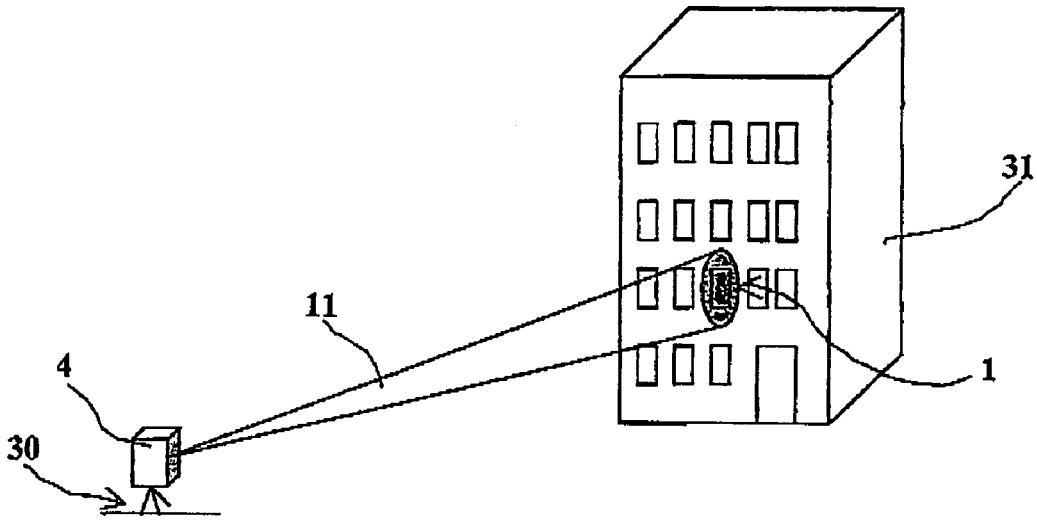
FIGS. 5*a*, 5*b*, 5*c* and 5*d* show four successive steps of operation for an attack system according to another mode of implementation from this first embodiment of the invention.

FIG. 5*a* shows the designator 4 resting on a support 30 and positioned away from a building 31. The detection cone 11 is aimed at one of the windows of the building, which constitutes the target 1 (an enemy weapon system can be found for example located at the window level).

Figure 5B:
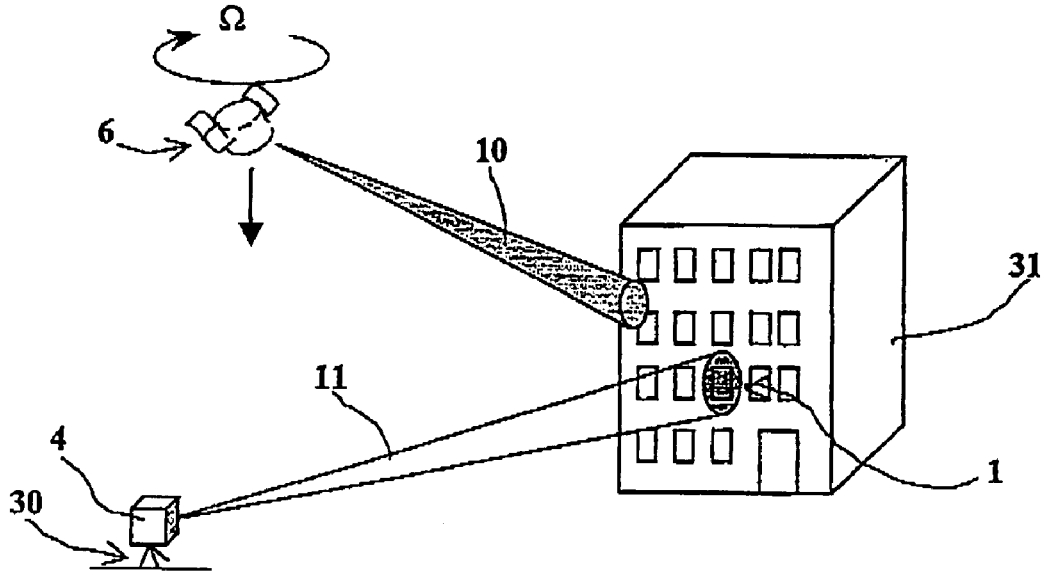
Figure 5C:
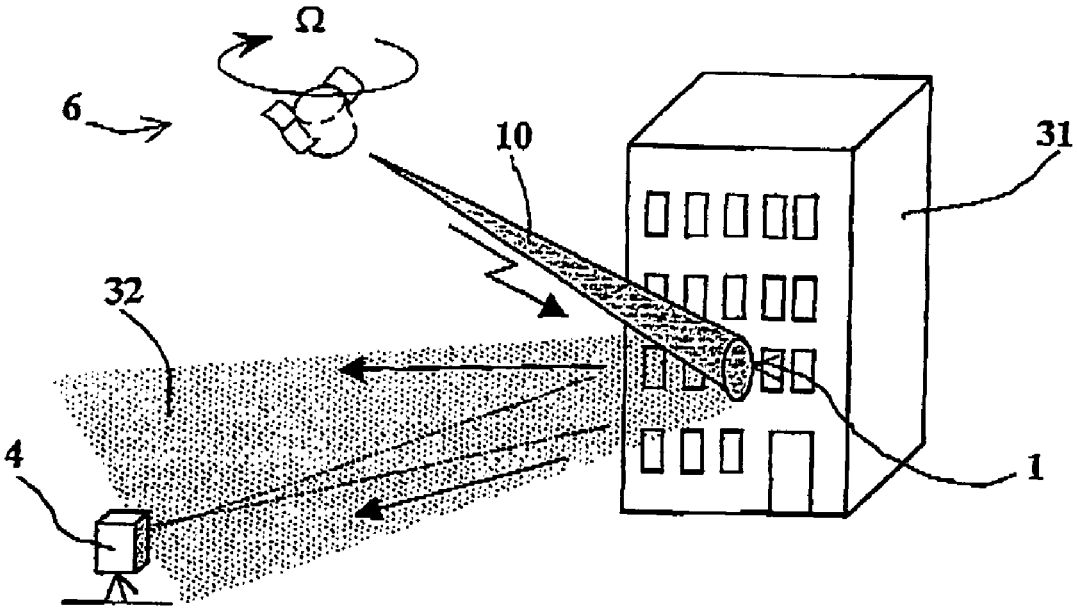
Figure 5D:
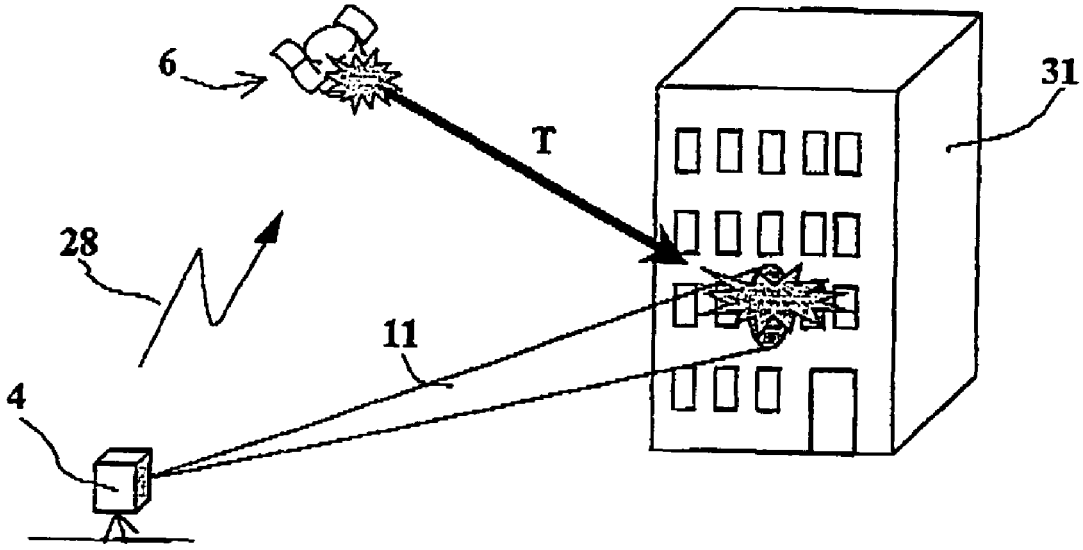

FIG. 5*b* shows a submunition 6 spinning with rotational movement Ω and going down vertically towards the ground. The laser beam 10 transmitted by this submunition 6 sweeps the ground along a spiral. When this beam reaches the level of the targeted window 1 (FIG. 5*c*), part of the laser beam is reflected (sector 32) at the designator 4. The latter spots the laser radiation and transmits an order of confirmation 28 towards the submunition (FIG. 5*d*). The latter is then initiated (arrow T) and destroys the target 1.

Figure 6:
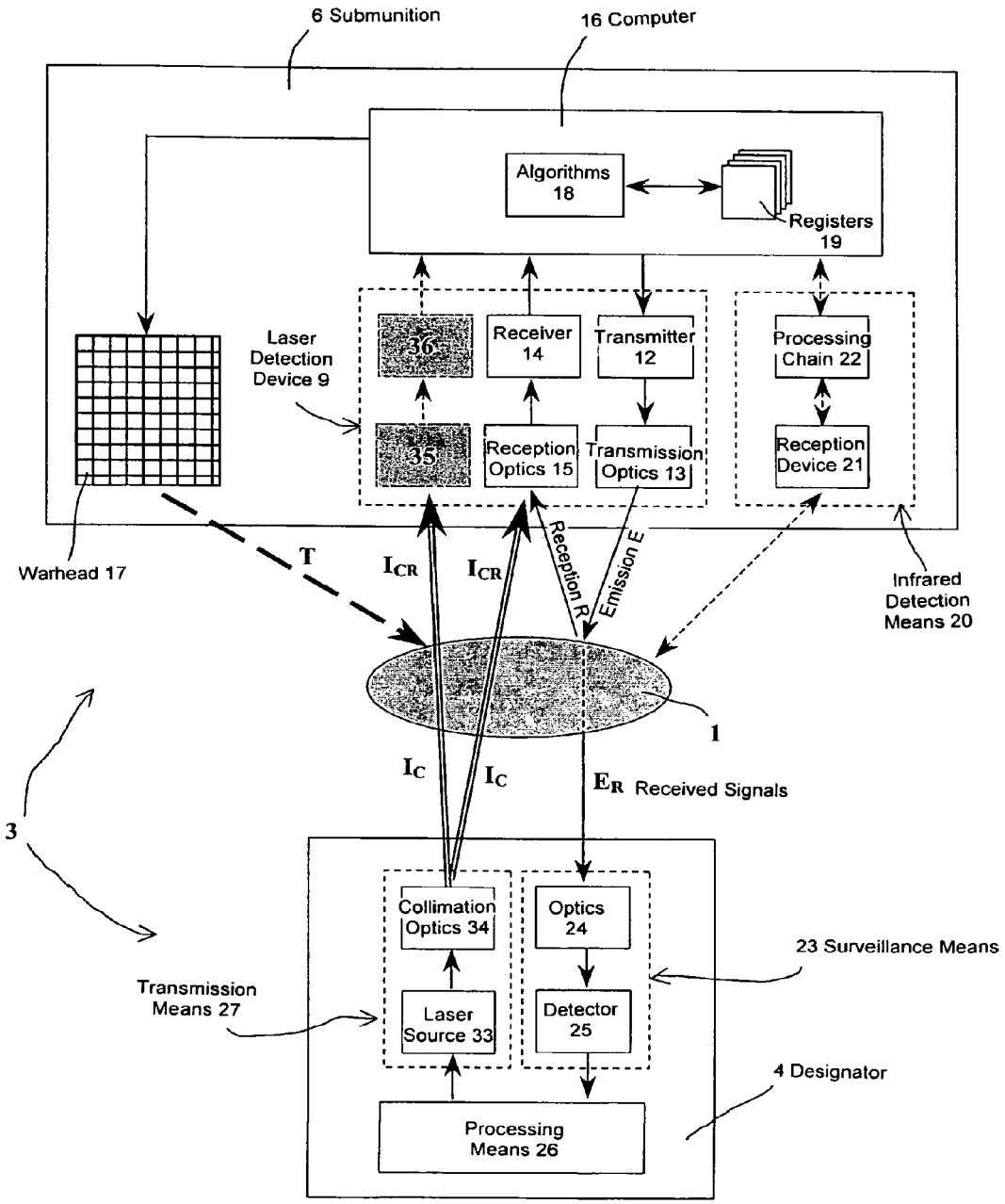
FIG. 6 is a schema showing the organization of an ammunition or submunition and of a designator according to a second embodiment of the invention.

FIG. 6 is a schema of the internal organization of the submunition 6 as well as that of the designator 4 according to a second embodiment of the invention.

As in the previous embodiment (FIG. 2) the submunition 6 integrates means of detection 9 which consist of a laser transmitter 12 coupled with a transmission optics 13, and a receiver 14 coupled with a reception optics 15.

Transmitter 12 and receiver 14 are both linked to the computer 16 which secures the initiation of signals transmission E by transmitter 12 and processes the signals R received by receiver 14.

Again, the computer 16 is used for controlling initiation of the warhead 17 and involves algorithms 18 and one or more memories or registries 19.

This figure also illustrates another means of detection 20 (for example infrared) including a receiving device 21 and a signal processing chain 22.

The attack system 3 according to this embodiment of the invention includes also a designator 4, which includes a passive optical surveillance means 23 like before, with optics 24 and a selected detector 25 which is sensitive to the laser radiation transmitted by transmitter 12.

This designator differs from the previous one in that the means of transmission 27 are optical transmission means associating a laser source 33 and a collimation optics 34. This transmission means 27 is controlled by the processing means 26. When the latter detects a signal $E_R$ transmitted by the laser source 9 from the submunition (signal E reflected by the target), it controls the delivery of at least one laser pulse $I_C$ towards the submunition via the target 1.

After reflection on the target, this pulse is received by means of detection 9 in the submunition.

At the submunition level, specific means of detection can be used (optics 35 and processing circuit 36) which are represented shaded in the figure.

More simply it will be possible to use means of laser reception 14 and 15 to detect the laser pulse of confirmation $I_C$. The latter solution presents the advantage that it does not modify the structure of the submunition nor the implemented means of detection.

The invention only undertakes in this instance a simple modification of algorithms 18 from computer 16 to secure the operation according to the method of the invention.

FIGS. 7*a* to 7*d* show the different steps of operation for the attack system according to this second embodiment.

Figure 7A:
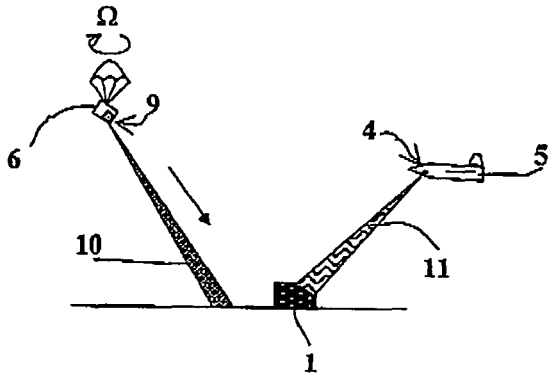
FIGS. 7*a*, 7*b*, 7*c* and 7*d* show four successive steps of operation for an attack system according to a mode of implementation from that second embodiment of the invention, FIGS. 8*a*, 8*b* and 8*c* indicate three successive steps of operation for an attack system according to another mode of implementation of this second embodiment of the invention.
Figure 7B:
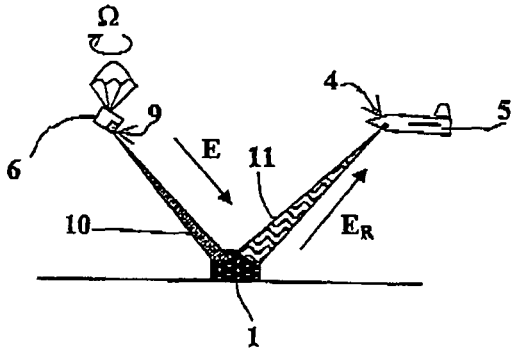

The first step is illustrated in FIG. 7*a*. The designator 4 carried by drone 5 has its cone of surveillance 11 aiming at the target 1.

The submunition 6 is spinning with rotational movement Ω and transmits towards the ground a laser beam 10 along a spiral path to secure sweeping of the field.

When the beam 10 meets the target 1 (FIG. 7*b*), part of the laser beam (E) transmitted is reflected (arrow $E_R$) and the laser radiation is then seen by the surveillance means of the designator 4.

Figure 7C:
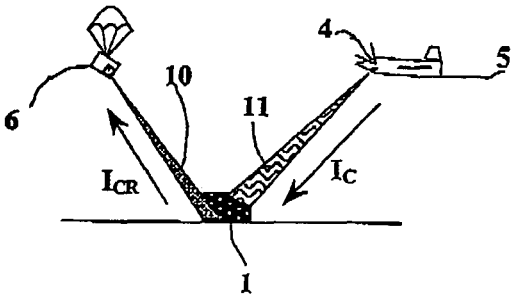

The designator recognizes the signal transmitted by a submunition 6 to which it is associated and it transmits in this instance a confirmation laser pulse (arrow $I_C$) towards the target 1 (FIG. 7*c*).

Figure 7D:
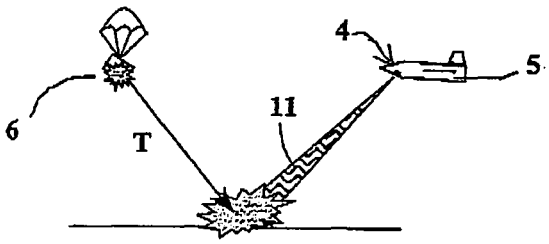

This pulse is reflected partly by the target (arrow $I_{CR}$) and it is retransmitted towards the submunition. When the latter receives the signal of confirmation, its computer 16 triggers firing of the warhead towards the target (FIG. 7*d*).

This embodiment of the invention has the advantage of simplifying the design of the submunition. It is not in fact necessary to provide specific means of reception in it for the signal of confirmation.

In a similar way to the one previously described when referring to FIGS. 5*a* to 5*d*, FIGS. 8*a*, 8*b* and 8*c* indicate another implementation mode for the invention using a ground-based designator 4.

Figure 8A:
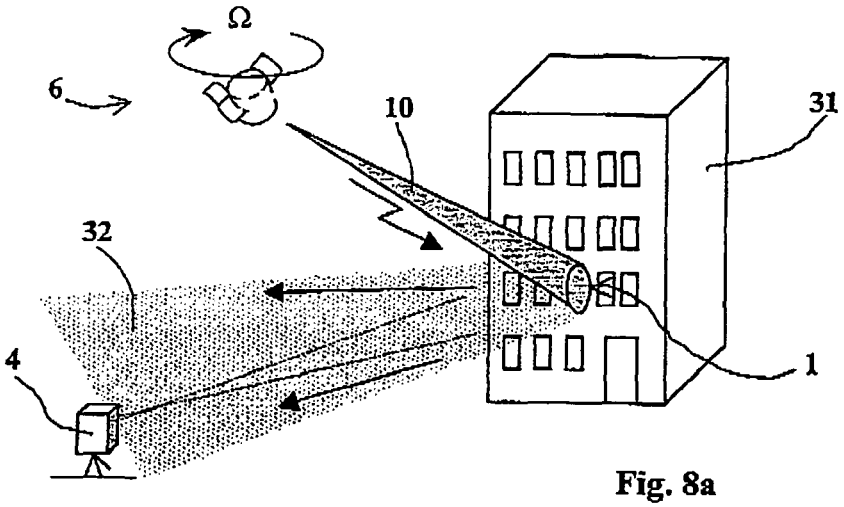
Figure 8B:
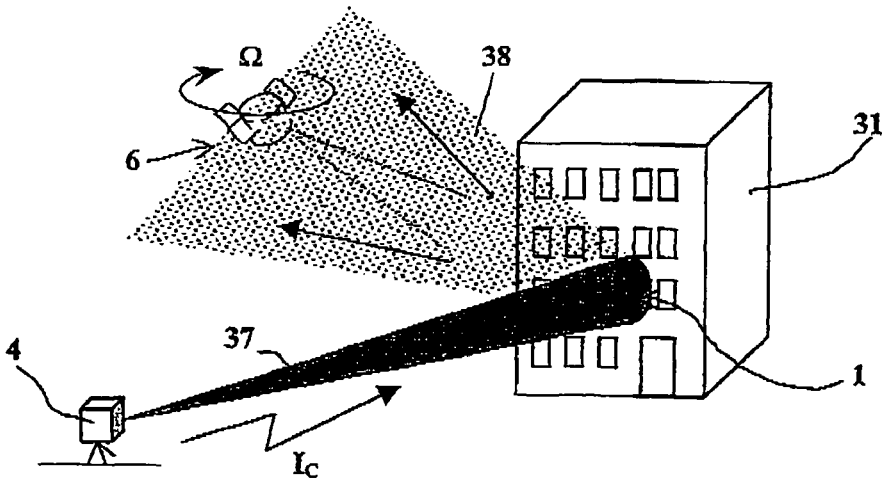
Figure 8C:
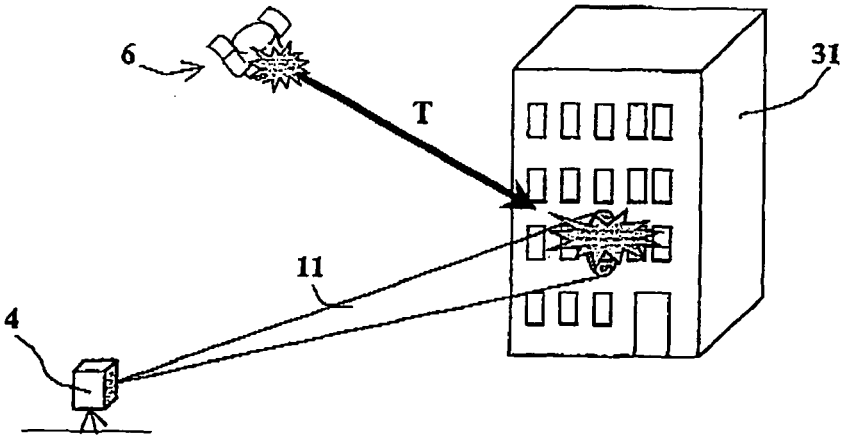

FIG. 8*a* shows a submunition 6 spinning with rotational movement Ω and going down vertically towards the ground. The laser beam 10 transmitted by this submunition 6 sweeps the field along a spiral path. When this beam reaches the level of the targeted window 1 (FIG. 8*a*), part of the beam is reflected (sector 32) towards the designator 4.

The latter recognizes the laser radiation and transmits (FIG. 8*b*) an order of confirmation in the form of a pulse $I_C$ aimed at the target 1. This pulse forms a beam 37 which is reflected partly (beam 38) towards the submunition 6.

When the submunition receives and recognizes the pulse of confirmation $I_C$ (FIG. 8*c*), it is then initiated (arrow T) and destroys the target 1.

Several variants are possible without leaving the scope of the invention. It is of course possible to make the designator interact with all types of aircrafts (plane, helicopter, drone). It can also be left on the ground or it can be carried either by an infantryman or land vehicle. It can also be carried by a remotely operated land robot. In this case it will be possible to equip the designator or robot with a camera for ease of control and guidance, this camera will be able in particular to play the role of a means of passive surveillance.

The invention has been described implemented with submunitions dispersed by a vector. This vector can be an artillery shell, a mortar projectile, a rocket or a drone.

It will also be possible to implement the invention from an ammunition fired by a weapon system (either a cannon or a howitzer or yet a rocket launcher).

What is essential is to have at the ammunition level a means of detection to secure sweeping of a field zone in order to recognize a target. Most ammunitions spinning with a rotational movement about their axis and equipped with target sensors meet this criterion and therefore can be associated with a passive target designator.

Figure 9:
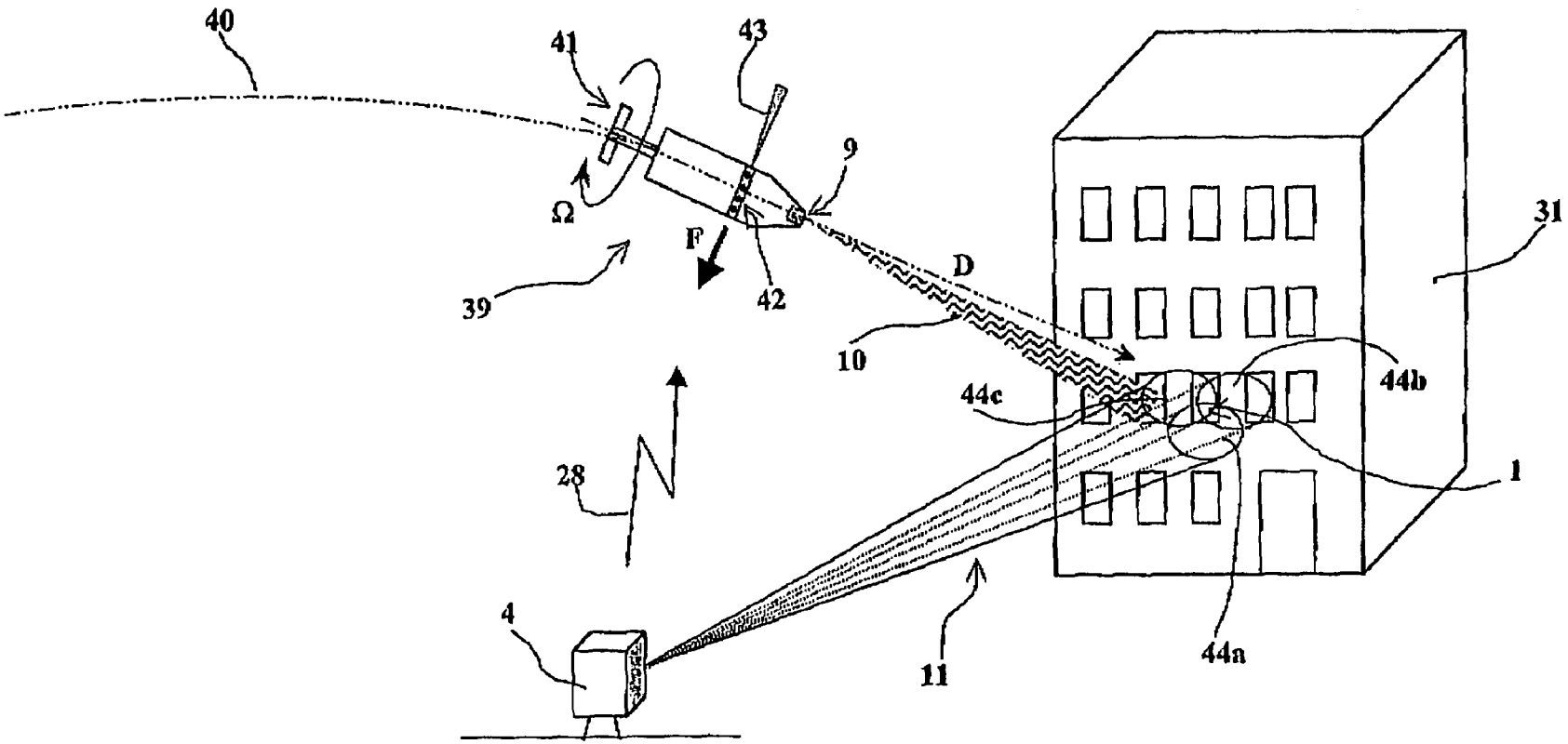
FIG. 9 is a schema showing the implementation of another embodiment of the invention.

FIG. 9 shows the schema of such an embodiment in which the ammunition 39 is fired by a weapon system (not represented) and follows a curved trajectory path 40 bringing it in proximity of a target 1 (here a window of a building 31).

This ammunition is stabilized here by a wing 41 giving it its rotational movement. The ammunition includes at the level of its warhead a means 9 of target detection, which projects a laser beam 10. The latter sweeps the air in spiral due to the rotational movement Ω of ammunition 39. Here the laser beam 10 is slightly inclined with respect to the firing axis D.

According to this particular embodiment, the ammunition 39 includes means 42 of trajectory correction.

These means feature here a crown of pyrotechnic thrusters. Indicated in 43 is the jet of one of these thrusters which exerts a force F on the ammunition 39 causing a trajectory change 40.

Ways of correcting trajectory by thrusters are well-known from the professionals in the art. It will be possible for example to refer to patents FR2632722 or FR2627268 which describe such means of trajectory correction.

It is of course possible to use other types of means of trajectory correction, such as canard fin systems. It will be possible to refer for example to patents FR2846080 and FR2864613 which describe such controlling fins.

In compliance with this embodiment of the invention, the means of passive surveillance for the designator 4 include an off-target meter aimed at differentiating at least between two detection zones 44 (here three zones are represented 44*a*, 44*b* and 44*c*). Such an off-target meter is conventional, the means of surveillance implementing a matrix of detectors can in this instance easily allocate coordinates to different points detected in the matrix plan.

The benefit of operating in this instance the means of surveillance at the designator 4 via an off-target meter is that it is then possible to determine the position of the laser beam 10 transmitted by the ammunition 39 with respect to the detection zones 44 materialized by the designator.

The means of processing 26 of the signals received by the designator will then be able to calculate position deviation data for the laser beam with respect to the target position (which is for example the zone common to the three detection zones).

In compliance with this embodiment of the invention, this deviation data will be transmitted by the means of transmission from the designator towards the ammunition 39 (arrow 28).

The latter will have the ability then to use this deviation data to correct its trajectory.

As in the case of the confirmation data, it is of course possible to transmit the deviation data either via radio or optics.

The computer 16 on-board the ammunition will process the off-target data in the same manner as if it was directly obtained from the means of detection on-board the projectile. Thanks to the designator, the projectile knows then the coordinates of the intersection of its firing axis D (which is here the axis of the ammunition) in the target plane. Of course, it is possible to determine an ammunition for which the firing axis of the warhead would be different.

These coordinates are expressed in deviations with respect to the desired point. With the projectile equipped with a unit of inertial measure, it knows its rotational position (it can also be equipped with a range-finder and obtain its distance from the target). The computer 16 is therefore able to obtain the thruster(s) that should be initiated to correct the orientation of the axis of fire D.

Instead of correcting the trajectory of the ammunition, it is also possible to change the direction of fire D (for example by implementing a warhead with adjustable direction of fire, for example by either changing the position of the head with respect to the projectile or by selecting a set of initiators with a localization allocated relative to the warhead.

It is possible to also use the off-target data only to correct the time of initiation of the warhead, without correction of trajectory nor a change in the direction of fire.

One will be able to initiate fire only when there is coincidence between the direction of fire and the designated zone.

For this particular embodiment, the order of confirmation is not entirely necessary. Only the off-target data are useful to correct the accuracy of firing.

It is however possible to transmit an order of confirmation which will trigger firing after one or several corrections of the direction of fire. Such an embodiment allows for further improvement of the accuracy of fire in particular in urban area avoiding in this instance collateral damages.

It is of course possible to process at the designator level an off-target meter that defines only two zones 44 or more than three zones 44.

The invention claimed is:

1. A method for controlling at least one of an ammunition or submunition by controlling at least one of a trajectory correction of the ammunition or submunition, firing, and direction of fire of a warhead, comprising:

sweeping a field zone using a laser beam from an ammunition or submunition comprising a warhead;

spotting a potential target located in the field zone using a passive surveillance means for detecting a reflection of such laser beam from the ammunition or submunition off a potential target, and transmitting from the passive surveillance means at least one of a confirmation order or a last off-target data to the ammunition or submunition, wherein the confirmation order is a command for at least one of initiation of firing, trajectory correction, and direction of fire of the warhead.

2. The method of claim 1, further comprising firing the warhead after the ammunition or submunition receives a confirmation order.

3. The method of claim 2, further comprising firing the warhead after the ammunition or submunition receives a confirmation order and a target detection means in the ammunition or submunition confirms that the target has characteristics corresponding with those of a potential target.

4. The method of claim 1, further comprising transmitting at least one of the confirmation order and the off-target data via a radio relay channel.

5. The method of claim 1, further comprising optically transmitting at least one of the confirmation order and the off-target data in the form of at least one laser pulse sent by the surveillance means to the target, and receiving at least one of the confirmation order and the off-target data, after reflection from the target, using detection means on-board the ammunition or submunition.

6. The method of claim 1, further comprising:

localizing the target by analyzing the off-target data with respect to at least two detection zones, and analyzing the off-target data to correct at least one of trajectory, direction of fire, and time of fire of the ammunition or submunition.

7. The method according to claim 1, further comprising:

transmitting at least one confirmation order or off-target data via transmission means coupled with at least one target designator located on the ground, on a vehicle, or on an aircraft, when the at least one target designator detects the reflection of the laser beam transmitted by the ammunition or submunition.

8. The method according to claim 7, further comprising:

determining a position of the laser beam transmitted by the ammunition or submunition with respect to at least two detection zones, using an off-target meter integrated with the at least one target designator, and analyzing the off-target data to correct at least one of trajectory, direction of fire, and time of fire.

9. The method according to claim 7, further comprising:

sending at least one of a confirmation order and the off-target data from the at least one target designator via a laser pulse aimed at the potential target.

10. The method according to claim 9, further comprising:

repetitively painting the potential target with a laser from the ammunition or submunition, the ammunition or submunition comprising at least one laser technology-based detection means comprising a transmitter and a receiver.

11. The method according to claim 10, further comprising:

receiving at least one of the confirmation order and the off-target data by the detection means, the at least one of the confirmation order and the off-target data being transmitted by the at least one target designator via a laser signal.

12. The method according to claim 7, wherein the ammunition or submunitions are dispersed over a field zone by a carrier.

13. An attack system comprising:

at least one of an ammunition and submunition comprising a warhead, a laser source incorporated in said at least one of an ammunition and submunition for sweeping a field zone, a passive surveillance means for detecting a reflection of a laser from said laser source off a potential target, a transmitter coupled to said passive surveillance means for transmitting at least one of a confirmation order and off-target data to said ammunition or submunition when a reflection of a laser from said laser source off a potential target has been detected by said passive surveillance means wherein the confirmation order is a command for at least one of a trajectory correction of the ammunition or submunition, initiation of firing and direction of fire of the warhead.

14. The attack system according to claim 13, wherein the passive surveillance means is a target designator located on the ground, on a vehicle, or on an aircraft.

15. The attack system according to claim 14, wherein the aircraft is a drone.

16. The attack system according to claim 14, wherein the target designator is ground-based or carried by a vehicle or infantryman.

17. The attack system according to claim 13, further comprising a carrier for dispersing said ammunition or submunition over a field zone.

18. An ammunition or submunition for use in the attack system according to claim 13, further comprising:

means for receiving at least one of a confirmation order to fire and off-target data from said passive surveillance source, and a computer for controlling warhead initiation coupled to said means for receiving at least one of a confirmation order and off-target data, said computer for being activated by a remote designator of the passive surveillance means.

19. An ammunition or submunition according to claim 18, further comprising at least one of means for correcting trajectory, direction of fire, and time of fire, said means capable of being activated by said computer for controlling warhead initiation upon receipt of at least one off-target data from a remote designator.

20. An ammunition or submunition according to claim 18, further comprising at least one optical target detection means, said at least one optical target detection means for receiving at least one of the confirmation order and the off-target data.

21. An ammunition or submunition for use in the attack system according to claim 20, wherein the optical target detection means is a laser-based target detection means comprising at least one transmitter and at least one receiver.

22. An ammunition or submunition for use in an attack system, the ammunition, or submunition, comprising:

a warhead, at least one laser source for pointing substantially in a direction of attack of said warhead, said laser source for painting a potential target with a laser beam while the ammunition or submunition is in flight, means for receiving at least one of a confirmation order to fire and off-target data from a passive surveillance source outside the ammunition or submunition, and a computer for controlling warhead initiation coupled to said means for receiving at least one of a confirmation order and off-target data, said computer for being activated by a remote designator of the passive surveillance means.

23. The ammunition or submunition according to claim 22, wherein the computer is for comparing an off-target data to such potential target using a reconnaissance algorithm comprising at least one characteristic of a hypothetical target.

24. The ammunition or submunition according to claim 23, wherein the computer is for:

initiating fire of the warhead upon detecting a target with at least one characteristic of a potential target, automatically initiating fire upon receiving a confirmation order, or initiating fire upon receiving a confirmation order, if the target also has at least one characteristic of a potential target.

25. A target designator for spotting a target on a field zone, comprising:

passive optical surveillance means for detecting a laser beam from at least one ammunition or submunition reflected off a potential target, the ammunition or submunition comprising a warhead, a transmitter for transmitting at least one of a confirmation order and off-target data upon detecting such laser beam from an ammunition or submunition and reflected off such potential target wherein the confirmation order is a command for at least one of a trajectory correction of the ammunition or submunition, an initiation of firing and direction of fire of the warhead.

26. A target designator according to claim 25, further comprising:

an off-target meter for determining the position of such laser beam, from such ammunition or submunition and reflected off such potential target, with respect to at least two detection zones, the transmitter for transmitting to such ammunition or submunition off-target data for correcting at least one of the trajectory, direction of fire, and time of fire, of such ammunition or submunition.

27. A target designator according to claim 26, wherein the transmitter is a radio transmitter.

28. A target designator according to claim 26, wherein the transmitter is an optical transmitter.

* * * * *